United States Patent [19]

Graef

[11] 4,104,004

[45] Aug. 1, 1978

[54] AIR ELIMINATOR FOR PUMPS

[75] Inventor: Myron Lee Graef, Hebron, Ill.

[73] Assignee: The De Laval Separator Company, Poughkeepsie, N.Y.

[21] Appl. No.: 741,300

[22] Filed: Nov. 12, 1976

[51] Int. Cl.[2] ..... F04B 21/00

[52] U.S. Cl. ..... 417/313; 137/202; 137/516.25

[58] Field of Search ..... 417/279, 307, 309, 310, 417/313; 137/516.25, 202

[56] References Cited

U.S. PATENT DOCUMENTS

| | | | |
|---|---|---|---|
| 1,698,990 | 1/1929 | Derryberry | 137/202 |
| 2,461,206 | 2/1949 | Fouse et al. | 137/516.25 X |
| 2,627,868 | 2/1953 | Runnels | 137/202 X |
| 2,693,196 | 11/1954 | Hundley | 417/279 X |
| 3,326,233 | 6/1967 | Perruzzi | 137/516.25 X |
| 3,868,198 | 2/1975 | Purtell | 417/279 X |

FOREIGN PATENT DOCUMENTS

| | | | |
|---|---|---|---|
| 1,237,479 | 6/1960 | France | 137/202 |
| 405,385 | 2/1934 | United Kingdom | 137/202 |

*Primary Examiner*—William L. Freeh
*Assistant Examiner*—Edward Look
*Attorney, Agent, or Firm*—Cyrus S. Hapgood

[57] ABSTRACT

Connected to the suction pipe leading to a pump inlet is an air eliminator comprising a valve housing defining a chamber and having a first valve seat through which the suction pipe communicates with the chamber and a second valve seat through which the chamber communicates with atmosphere, the chamber increasing in cross-sectional area from the first seat toward the second seat. A ball valve is normally seated on the first seat to prevent air from entering the suction pipe but is displaceable to allow discharge of air under pressure from the suction pipe through the second seat while suspended by the force of the discharging air. The ball valve has a specific gravity less than the liquid, whereby liquid entering the chamber from the suction pipe floats the ball valve against the second seat to block the discharge of liquid.

4 Claims, 2 Drawing Figures

AIR ELIMINATOR FOR PUMPS

This invention relates to air eliminators and more particularly to a novel device for eliminating air from the suction line of a pump.

In the operation of certain pumps for pumping liquids, air will at times accompany the liquid passing through the suction pipe to the pump inlet. This is objectionable, particularly in the case of centrifugal pumps. In fact, it can impair the pumping operation and even lead to damaging of the pump.

The principal object of the present invention is to provide a device connected to the suction pipe for eliminating the air before it can reach the pump, while preventing escape of liquid from the pipe.

In an air eliminator made according to the invention, a valve housing defines a chamber and has a first valve seat through which the suction pipe of the pump communicates with the chamber and a second valve seat through which the chamber communicates with atmosphere, the chamber increasing in cross-sectional area from the first seat toward the second seat. A ball valve is normally seated on the first seat to prevent air from entering the suction pipe but is displaceable to allow discharge of air under pressure from the suction pipe through the second seat while suspended by the force of the discharging air. The ball valve has a specific gravity less than that of the liquid, whereby liquid entering the chamber from the suction pipe floats the ball valve against the second seat to prevent discharge of liquid from the chamber.

Figure 1:
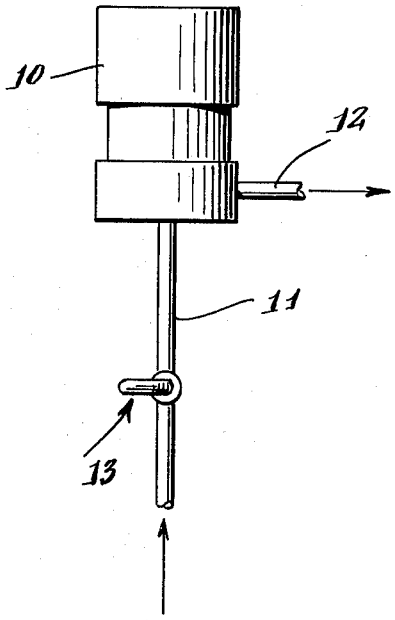
Figure 2:
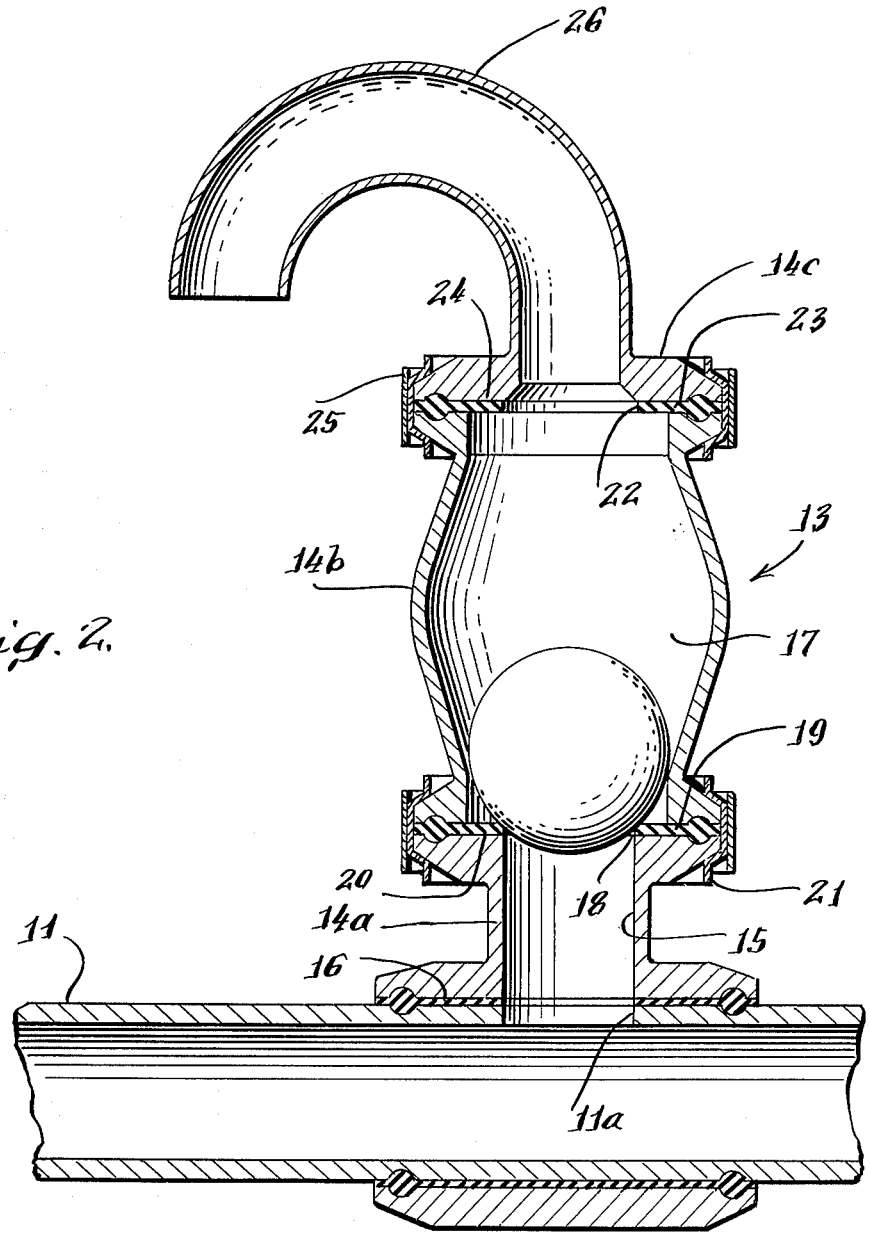

These and other features of the invention will be better understood by reference to the accompanying drawing, in which FIG. 1 is a schematic view of a pump having a suction pipe leading to the pump inlet and to which the new air eliminator is connected, and FIG. 2 is a longitudinal sectional view of a preferred form of the air eliminator shown in FIG. 1.

Referring to FIG. 1, a pump 10, such as a centrifugal pump, has an inlet to which a suction pipe 11 leads for conveying liquid to be pumped. The pump outlet is connected to a discharge pipe 12 for the pumped liquid. The air eliminator of the present invention is connected to the suction pipe 11 and is indicated generally at 13.

As shown in FIG. 2, the air eliminator 13 comprises a housing made up of three sections **14*a*, 14*b* and 14*c*. The lowermost section 14*a* forms a passage 15 of circular cross-section which is aligned with an opening 11*a* in the wall of suction pipe 11. A gasket 16 is interposed between housing section 14*a* and the wall of pipe 11, the gasket having a central opening aligned with the pipe opening 11*a*. Conventional means (not shown) are provided for releasably clamping the housing section 14*a* against pipe 11 so as to compress the gasket 16, thereby providing a seal around the pipe opening 11*a***.

The intermediate housing section **14*b* forms a chamber 17 to which the passage 15 leads by way of a first valve seat 18. The valve seat 18 is formed by a gasket 19 inserted between the housing sections 14*a* and 14*b* and overlying an inwardly projecting ledge 20 of section 14*a*. Releasable clamping means 21 of any conventional type are provided for clamping the housing sections 14*a* and 14*b* together so as to compress the gasket 19**.

At the upper end of chamber 17 is a second valve seat 22 forming a discharge opening through which the chamber leads to atmosphere by way of the third housing section **14*c*. A gasket 23 is interposed between the housing sections 14*b* and 14*c*, the radially inner portion of this gasket underlying a ledge 24 of section 14*c* to form the second valve seat 22. Releasable clamping means 25 of conventional form are provided for clamping the sections 14*b* and 14*c* together so as to compress the gasket 23. Housing section 14*c* forms a tube 26 for discharging air from chamber 17**.

The chamber 17 forms a passage extending vertically between the two valve seats 18 and 22. As shown in FIG. 2, this passage has a circular cross-section which increases in throughflow area from the lower valve seat 18 toward the upper valve seat 22. This passage formed by chamber 17 has its maximum cross-sectional area intermediate the ends of housing section **14*b* and then tapers upwardly from this maximum area toward the second valve seat 22**.

A ball valve 28 is disposed loosely in chamber 17 and is adapted to seat alternately against the valve seats 18 and 22 so as to close the openings formed by the respective seats. The ball valve has a specific gravity substantially less than that of the liquid passing through the suction line 11. Thus, if the liquid to be pumped is water or another liquid having a specific gravity at least as great as that of water, the specific gravity of the ball valve 28 will be substantially less than 1.0. Preferably, the ball valve is made of rubber or a plastic type material having the essential properties of rubber and which will not adversely affect the liquid being pumped when contacted therewith.

In the operation of the air eliminator, ball valve 28 is normally held seated on the first valve seat 18 by the suction in pipe 11 leading to the pump 12, thereby preventing entrance of air into this pipe. However, a slug of air passing through pipe 11 will exert sufficient pressure to lift the ball valve from seat 18 so that the air can discharge to atmosphere by way of the upper seat 22 and tube 26. This discharging air cannot lift the ball valve to the upper seat 22 because of the gradually increasing throughflow area of chamber 17 from the lower end of housing section **14*b* to its intermediate portion. That is, as ball valve 28 moves upwardly from seat 18, the air discharges by way of a gradually increasing annular throughflow area between the ball valve and the surrounding wall of housing section 14*b*, whereby the ball valve will be centrally suspended in chamber 17 by the force of the discharging air. When the air slug has discharged through valve seat 18 and the liquid flow is resumed along pipe opening 11*a* at the normal pressure, ball valve 28 returns against seat 18 where it is again held by the suction in pipe 11**.

It sometimes happens that a positive suction pressure occurs in pipe 11 leading to the pump 10. In that event, ball valve 28 is raised from seat 18 by liquid flowing through inlet passage 15. However, since the liquid has a higher specific gravity than the ball valve, the latter will float on the surface of the liquid as it fills the chamber 17, until the ball valve is pressed against the upper seat 22, thereby preventing escape of liquid through the air eliminator. When the negative suction pressure is restored in pipe 11, the liquid drains from chamber 17 to valve seat 18 and back into pipe 11, until the ball valve is again seated on the latter valve seat.

Thus, the ball valve 28 functions to allow discharge of air from suction line 11; but due to the specific gravity of the ball valve, only liquid entering the chamber 17 can lift the ball valve sufficiently to seal off the upper valve seat 22.

The air eliminator as shown in FIG. 2 is especially adapted for use where sanitary conditions are required, as in the processing of products for human consumption. The air eliminator is capable of in-place cleaning and can be easily disassembled for cleaning or repair by releasing the clamping means 21 and 25.

It has been proposed heretofore to provide a ball check valve somewhat similar in construction to the present air eliminator, such a check valve being disclosed in U.S. Pat. No. 3,055,391 granted Sept. 25, 1962. However, this check valve cannot function in the manner of the present air eliminator because the ball member of the check valve is made of metal so that it has a specific gravity substantially greater than that of the liquid flowing into the valve. Thus, the check valve is suitable only for use in permitting continuous flow of the liquid in one direction therethrough except under extremely high pressure conditions and preventing flow of the liquid in the opposite direction through the valve.

I claim:

1. In combination with a pump having an inlet and an outlet, and a suction pipe leading to said inlet for conducting a liquid to be pumped, an air eliminator comprising a valve housing having an inlet passage at one end thereof in sealed communication with said suction pipe, the housing defining a chamber and having a first valve seat through which said inlet passage communicates with the chamber, the housing having at the opposite end thereof a second valve seat forming a discharge opening leading to atmosphere, said chamber forming a main passage which increases and then decreases in cross-sectional area from said first valve seat toward said second valve seat, a ball valve in said chamber adapted to seat alternately on the valve seats, the ball valve being normally seated only on said first valve seat to prevent entrance of air into the suction pipe but being displaceable from the first seat to allow discharge of air under pressure from the suction pipe through said second valve seat while suspended by the force of the discharging air, the ball valve having a specific gravity less than that of said liquid, whereby liquid entering the chamber from the suction pipe floats the ball valve against said second seat to prevent discharge of liquid from the chamber, the housing including a first section forming said inlet passage and a second section separable from the first section and forming said chamber, a compressible gasket inserted between said first and second sections and forming said first valve seat, and releasable means located outside the housing for clamping said sections together to compress said gasket.

2. The combination of claim 1, in which the ball valve has a specific gravity less than 1.0.

3. The combination of claim 1, in which the ball valve is made of a rubber-like material.

4. The combination of claim 1, in which the housing also includes a third section forming a discharge tube leading from said discharge opening to atmosphere, the combination comprising also a second gasket inserted between said second and third sections and forming said second valve seat, and second releasable means located outside the housing for clamping said second and third sections together to compress said second gasket.

* * * * *